United States Patent [19]

Chuang

[11] Patent Number: 4,960,022

[45] Date of Patent: Oct. 2, 1990

[54] PLASTIC FILM CUTTER

[76] Inventor: Kuo C. Chuang, 1 Fl., No. 2, Alley 1, Lane 394, Chung Cheng N. Road, Sanchung, Taipei Hsien, Taiwan

[21] Appl. No.: 319,769

[22] Filed: Mar. 7, 1989

[51] Int. Cl.[5] ..... B26D 7/14; B26D 5/08; B26D 7/00

[52] U.S. Cl. ..... 83/175; 83/614; 83/649

[58] Field of Search ..... 30/278, 279 R, 280, 30/282, 314, 299, 294, 290; 83/614, 175, 649

[56] References Cited

U.S. PATENT DOCUMENTS

| | | | |
|---|---|---|---|
| 3,688,625 | 9/1972 | Thomas et al. | 83/649 |
| 3,981,215 | 9/1976 | Granger et al. | 83/614 |
| 4,210,043 | 7/1980 | Urion et al. | 83/175 |
| 4,245,536 | 1/1981 | Urion | 83/649 |
| 4,754,674 | 7/1988 | Perlman | 83/614 |
| 4,787,284 | 11/1988 | Chen | 83/614 |

FOREIGN PATENT DOCUMENTS

| | | | |
|---|---|---|---|
| 678401 | 1/1964 | Canada | 83/649 |
| 445016 | 12/1974 | U.S.S.R. | 83/649 |

*Primary Examiner*—Douglas D. Watts
*Assistant Examiner*—Paul M. Heyrana, Sr.
*Attorney, Agent, or Firm*—Schwartz & Weinrieb

[57] ABSTRACT

A plastic film cutter comprising a supporting board with its two sides provided with a plurality of clamping plates, a sliding furrow is formed upon the top of the supporting board for supporting the lower sliding seat of the slidable cutting means, and a slidable cutting means with its lower sliding seat inserted into the sliding forrow. Upon the bottom surface of the upper push button of the cutting means, there provided rollers for engaging and maintaining the plastic film in a tensioned state, the blades for cutting the plastic film are inserted into a slit formed upon the upper surface of the lower sliding seat of the cutting means.

10 Claims, 4 Drawing Sheets

PLASTIC FILM CUTTER

FIELD OF THE INVENTION

This invention relates to the field of plastic film cutters particularly suited for clamping the film upon one side of the packing box of plastic film and which can cut the plastic film bidirectionally.

BACKGROUND OF THE INVENTION

The plastic films sold in the market for keeping food fresh are shown packaged as in FIG. 1A, wherein outside of the packing box 100, there is provided a strip of cutting teeth 101. In order to use the plastic film, people have to find the starting end of the roll of plastic film, pull the film outwardly to a predetermined proper length, cause the film to contact the cutting teeth 101, and then by using the cutting teeth, tear the film gradually. During such operation, if the people do not tear the film carefully, the plastic films are always torn in an irregular manner or they tend to stick together because of static electricity. This makes people very unpleasant and feel very frustrated, and besides, it is a waste of materials. Furthermore, it is very easy for people to injure their hands due to carelessness. In order to avoid the defects mentioned above, there is also provided or known a box having a sliding cutter for the plastic film, as shown in FIG. 1B. In order to use the plastic film, the roll of plastic film is firstly put into the storage box, however, after a long period of use, the inner space of the storage box will become very dirty and will stain the plastic film which was clean originally. Moreover, as shown in FIG. 2A, the cutting blade 202 upon the push button 201 of the cutting means disposed within the storage box is formed with one cutting edge at one side, such that the plastic film can only be cut in one direction. After one cutting operation is completed, the push button 201 has to be pushed back to its original position. Furthermore, as shown in FIG. 2B, the one-sided cutting blade 202 is inserted into the push button 201 with its cutting edge inclined inwardly so as to cut the plastic film. A resisting force tending to obstruct the cutting of the plastic film will therefore naturally be developed whereby the cutting end of the plastic film will be pushed downwardly and will tend to be gathered within the vicinity of the button by means of the cutting edge of the cutting blade 202. As a result, the plastic film has to be pulled tightly against the T-shaped furrow of the cutter. If the pulling force is not sufficient, the plastic film will be gathered as described before and cannot be properly cut.

Moreover, the size of the plastic film storage box with the sliding cutter as shown in FIG. 2A is fixed and not suited for plastic films with different sizes. This is also a defect of the improved plastic film storage box provided with a sliding cutter.

OBJECT OF THE INVENTION

In view of the above mentioned defects faced by users, it is an object of this invention to provide a plastic film cutter by which the cutter will clamp itself to one side of the storage box for the plastic film. Consequently, it can be used for many plastic films having different sizes and the plastic films will be maintained clean.

SUMMARY OF THE INVENTION

According to the plastic film cutter of this invention, there are rollers disposed upon the bottom surface of the push button cutting means. Therefore, the plastic film will be pressed and pulled tightly for easily and smoothly cutting, the same such being another object of the present invention.

According to the plastic film cutter of this invention, because the plastic film will be pressed and pulled tightly during the cutting operation, the plastic film will not gather at the bottom of the cutting blade, it is very comfortable to use the cutter of this invention, and this is a further object of the present invention.

BRIEF DESCRIPTION OF THE DRAWINGS

A more complete understanding of these and other features and advantages of the present invention will become apparent from a careful consideration of the following detailed description of certain embodiments illustrated in the accompanying drawings, in which like reference characters designate like or corresponding parts throughout the several views, and wherein.

DETAILED DESCRIPTION OF THE INVENTION

The structures and the defects of the conventional plastic film storage box as showin in FIGS. 1A, 1B and FIGS. 2A, 2B are described above.

Figure 1A:
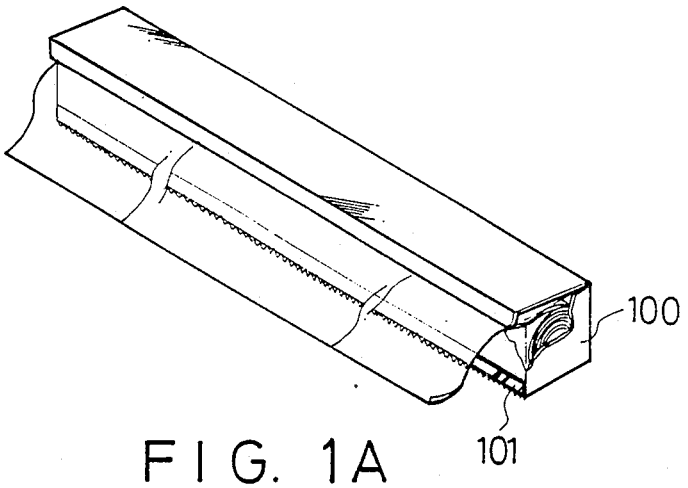
FIG. 1A PRIOR ART
FIGS. 1A and 1B are perspective views showing plastic film roll storage boxes with conventionally known cutting means.
Figure 1B:
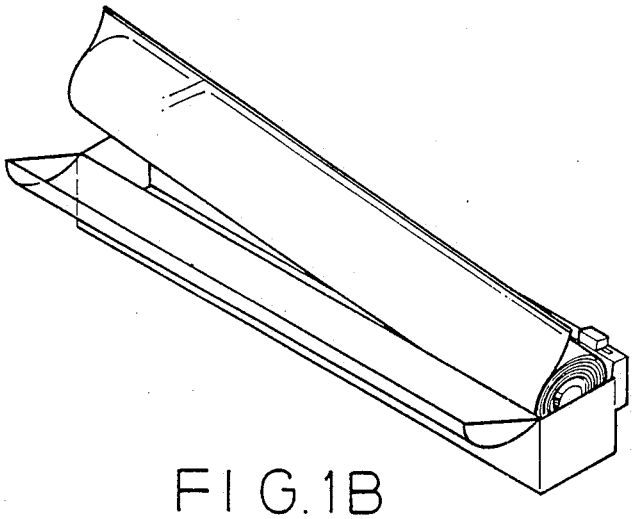
FIG. 1B PRIOR ART
Figure 2A:
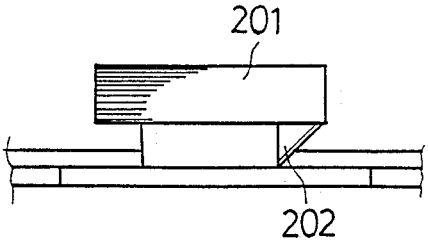
FIG. 2A PRIOR ART
FIGS. 2A and 2B are side views showing the structure of the cutter of the conventional of plastic film roll storage box.
Figure 2B:
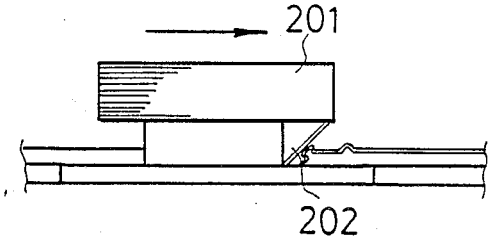
FIG. 2B PRIOR ART
Figure 3A:
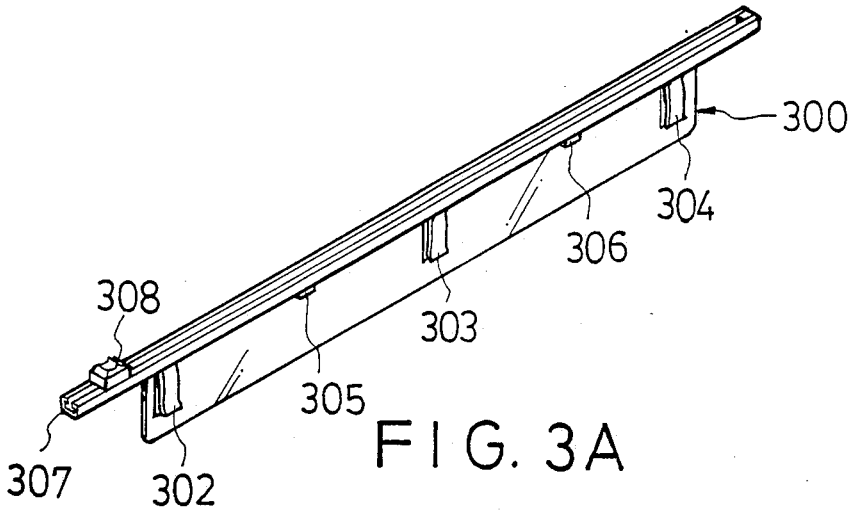
FIG. 3A is a perspective view showing a fully assembled embodiment of the invention.
Figure 3B:
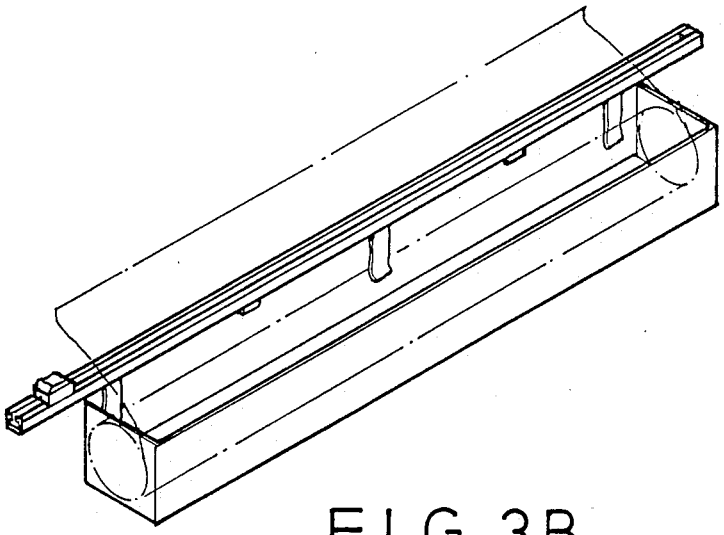
FIG. 3B shows a common method for using the present invention.

As shown in FIG. 3A, the main part of the present invention is a supporting board 300, upon the two sides of which, there are a plurality of clamping plates 302, 303, 304; 305, 306. Between the supporting board 300 and each of the clamping plates, there is defined a gap for holding the side wall of any storage box for a plastic film roll (as shown in FIG. 3B). Upon the top edge of the supporting board 300, there is disposed a T shaped sliding furrow 307, a slidable cutting means 308 being slidably disposed within the sliding furrow 307. In order to cut the plastic film, it is simply needed to pull the free end of the plastic film and left its end be supported upon the top surface of the furrow. If a person then presses the upper surface of the push button 308A of the cutting means with a finger tip and pushes the button sliding inside the T shaped sliding furrow 307 from one end to another, then the plastic film will be cut apart from the plastic film roll for covering the foods or the like. It can cut the plastic film bi-directionally, and is very convenient to use.

Figure 3C:
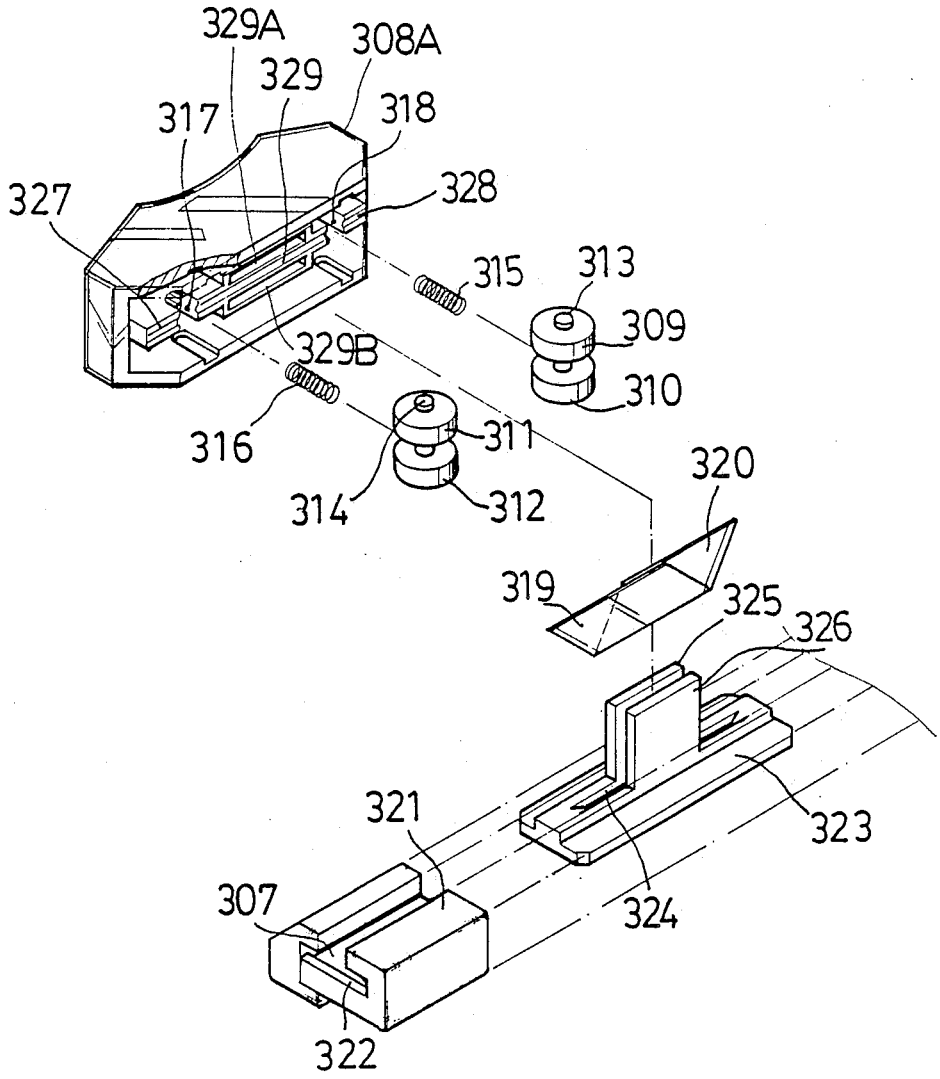
FIG. 3C is an exploded perspective view showing the components of the invention.

Referring to FIG. 3C, on the bottom surface of the upper push button 308A of the cutting means 308, there are disposed rollers 309, 310, 311, 312 for keeping the plastic film in a tensioned or flat state, each of the two rollers being disposed upon the same axle 313 or 314 respectively, each of the two axle then being inserted into a holding seat 317 or 318 with a spring 315 or 316 being disposed interiorly of the pushbutton housing. The elastic forces of the springs will then act upon the rollers, so as to engage the plastic film by directly engaging the axles 313, 314. At the same time, when the inclined cutting edges of the cutting blades 319, 320 cut into the plastic, film the rollers will engage the plastic film and tension the same because the rollers are engaged upon the upper face 321 of T-shaped sliding furrow 307. The plastic film will be held tight upon the upper surface 321 of T-shaped sliding furrow 307, and the cutting operation will be effected very well, whereby the plastic film will not gathered at the bottom of the cutting blade 319 or 320. In addition, upon each of the two ends of the T-shaped furrow 307, there is disposed a stopper 322 extending upwardly with a very small height, the upper surface of at least one of the stoppers 322 being inclined outwardly so as to enable the sliding seat 323 of the cutting means 308 to be inserted into the T-shaped furrow 307, such that after the sliding seat 323 of the cutting means 308 is pushed into the T-shaped sliding furrow, the cutting means 308 will not slide out of the furrow 307. The blades 319, 320 are inserted into the slit 324 formed within the sliding seat 323 of the cutting means 308, the outer sides of the blades then being supported by means of the clamping walls 325, 326 formed upon the sliding seat 323 respectively. As the pressing plate 329 formed at the center part of the bottom of button 308A is inserted into the gap formed between the clamping walls 325, 326, the pressing plate 329 will contact the upper edges of the blades 319, 320 and the other plates 329A, 329B, formed laterally outwardly of the pressing plate 329 engage the clamping walls 325, 326 so as to clamp the blades 319, 320 therebetween. In addition the stoppers 327, 328 formed inside the push button 308A will also press the blades 319, 320 downwardly so as to hold the blades 319, 320 fixed at their positions and prevent the blades 319, 320 from moving horizontally when the plastic film is being cut.

Figure 3D:
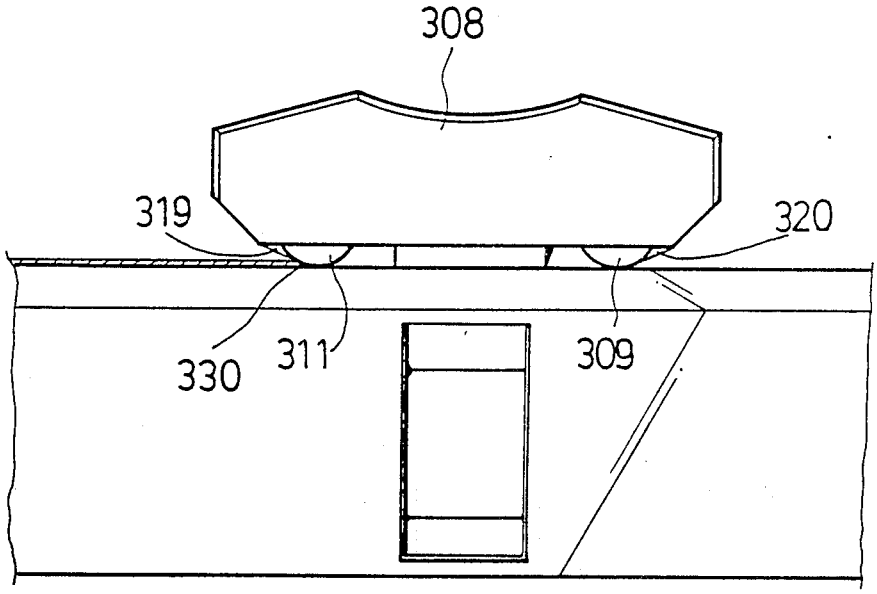
FIG. 3D shows the cutting means of the present invention in use.

Referring to FIG. 3D, it can be clearly seen that the position where the blade 319 or 320 cuts the plastic film 330 is located upon the same lateral or transverse line as the position where the rollers 311. 312 engage the plastic film 330, such that the plastic film is pulled tight as it is being cut by means of the blade 319 or 320. As a result, no resistance is developed as the cutting is performed, the plastic film 330 will not gather at the bottom of the cutting edge of the blade 319, or 320, and besides, after one section of the plastic film is cut apart from the film roll by means of the blade 319, the push button 308A of cutting means 308 need not necessarily be pushed to its original position because people can use the blade 320 with its inclined cutting edge to perform another cutting operation. It is very convenient and exhibits effects which the conventional plastic film cutter did not have.

Although the present invention has been described with a certain degree of particularity, the present disclosure has been made by way of example and changes in details of structure may be made without departing from the spirit thereof.

I claim:

1. A plastic film cutter, comprising:

means housing a supply of plastic film to be cut;

a furrow fixedly supported within the vicinity of said housing means and including an upper surface upon which a portion of said plastic film may be supported during a cutting operation;

a cutting means, including at least one cutting blade, slidably supported upon said furrow for cutting said plastic film during movement of said cutting means along said furrow from one end portion of said furrow to another end portion of said furrow; and roller means, disposed within said cutting means and upon opposite sides of said at least one cutting blade, for engaging said plastic film disposed upon said upper surface of said furrow so as to rollably support said cutting means upon said furrow and to maintain said plastic film in a tensioned state while said at least one cutting blade cuts said plastic film.

2. A plastic film cutter as set forth in claim 1, wherein:

said means housing said supply of plastic film is a box container; and said supply of plastic film comprises a roll of plastic film disposed within said box container.

3. A plastic film cutter as set forth in claim 2, further comprising:

a support board fixedly supporting said furrow along one edge portion of said support board; and clamping means mounted upon said support board for clamping said support board to a sidewall portion of said box container.

4. A plastic film cutter as set forth in claim 1, wherein:

said furrow includes a substantially T-shaped slot defined within the vicinity of said upper surface thereof; and said cutting means includes a substantially T-shaped base portion for slidable movement within said substantially T-shaped slot defined within said furrow.

5. A plastic film cutter as set forth in claim 4, further comprising:

stopper means disposed at opposite ends of said slot for retaining said cutting means within said furrow.

6. A plastic film cutter as set forth in claim 4, wherein:

said base portion of said cutting means includes two laterally spaced, upstanding wall portions having a gap defined therebetween for housing said at least one cutting blade.

7. A plastic film cutter as set forth claim 6, wherein:

said cutting means further includes an upper pushbutton type housing;

a central plate is provided within said housing for engaging an upper surface of said at least one cutting blade so as to maintain said at least one cutting blade between said upstanding wall portions of said base portion as a result of said central plate being accommodated within said gap defined between said upstanding wall portions; and a pair of slots, defined upon opposite sides of said central plate within said housing, for accommodating upper portions of said upstanding wall portions of said base.

8. A plastic film cutter as set forth in claim 1, wherein:

said cutting means includes two cutting blades, each one of said two cutting blades having a cutting blade surface disposed toward opposite end portions of said furrow whereby said cutting means comprises a bi-directional cutting means capable of cutting said plastic film when said cutting means is moved in either one of two directions along said furrow.

9. A plastic film cutter as set forth in claim 8, wherein:

said roller means comprises two pairs of rollers, each pair of rollers being disposed upon opposite sides of a respective one of said cutting blades such that peripheral portions of said roller means which engage said plastic film are disposed within a common transverse plane along with portions of said cutting blades which engage said plastic film for cutting said plastic film whereby said plastic film will be maintained in said tensioned state by said roller means while said cutting blades cut said plastic film.

10. A plastic film cutter as set forth in claim 1, wherein:

said roller means comprises two pairs of rollers disposed at opposite ends of said cutting means.

* * * * *